US011248821B2

(12) United States Patent
Zhong et al.

(10) Patent No.: US 11,248,821 B2
(45) Date of Patent: Feb. 15, 2022

(54) AIRWAY DEVICE

(71) Applicants: Panasonic Ecology Systems Guangdong Co., Ltd., Guangdon (CN); Panasonic Corporation, Osaka (JP)

(72) Inventors: Shenghui Zhong, Guangdong (CN); Daisuke Kanematsu, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 135 days.

(21) Appl. No.: 16/738,080

(22) Filed: Jan. 9, 2020

(65) Prior Publication Data

US 2020/0271350 A1 Aug. 27, 2020

(30) Foreign Application Priority Data

Feb. 27, 2019 (CN) ..... 201920248246.9

(51) Int. Cl.

| | |
|---|---|
| ***F24F 13/078*** | (2006.01) |
| ***F21V 29/67*** | (2015.01) |
| ***F21V 33/00*** | (2006.01) |
| *F24F 7/00* | (2021.01) |

(52) U.S. Cl.

CPC ..... *F24F 13/078* (2013.01); *F21V 29/673* (2015.01); *F21V 33/0092* (2013.01); *F24F 2007/002* (2013.01)

(58) Field of Classification Search

CPC . F24F 13/078; F24F 2007/002; F21V 29/673; F21V 33/0092

USPC ..... 454/354

See application file for complete search history.

(56) References Cited

U.S. PATENT DOCUMENTS

| | | | | |
|---|---|---|---|---|
| 7,175,309 | B2 * | 2/2007 | Craw | F21V 33/0092 362/253 |
| 8,641,375 | B2 * | 2/2014 | Tian | F24F 7/007 416/5 |
| 9,175,874 | B1 * | 11/2015 | Tom | F04D 19/00 |
| 2017/0205082 | A1 * | 7/2017 | Kim | F24F 11/77 |

* cited by examiner

*Primary Examiner* — Vivek K Shirsat
*Assistant Examiner* — Ko-Wei Lin
(74) *Attorney, Agent, or Firm* — RatnerPrestia

(57) ABSTRACT

The present disclosure provides an airway device. The airway device includes: a main housing provided with a suction port and a blow port; an air passage having a cylindrical shape, and having an inner circumferential surface defining an air flow path from the suction port to the blow port; and a lighting unit for illuminating the inner circumferential surface. The airway device can be used alone or together with blower and the like to form a ceiling mounted ventilation fan. Compared with the prior art, the ventilating fan device has the advantages of small air pressure loss, high ventilation efficiency, high lighting efficiency and convenient maintenance.

14 Claims, 8 Drawing Sheets

AIRWAY DEVICE

CROSS REFERENCE TO RELATED APPLICATION

This application claims priority to Chinese Patent Application No. 201920248246.9, filed Feb. 27, 2019, the contents of such application being incorporated by reference herein.

TECHNICAL FIELD

The present disclosure relates to an airway device.

BACKGROUND

In prior art, one form of an airway device is a ceiling mounted ventilation fan. The ceiling mounted ventilation fan of various structures generally has the following common structure: a main housing provided in the ceiling and a blower provided in the main housing, and the indoor air is drawn from the air inlet opened at the ceiling surface into the main housing, and the drawn air is discharged by a ventilation passage connected to the main housing under the action of the blower.

In addition, in the main housing of such ceiling mounted ventilation fan, in addition to the blower, sometimes devices having other functions such as a lighting fixture, a speaker, various notification devices, or an electric heater may be provided, such that it is possible to introduce light, sound, heat, etc. into indoors through an opening of the ceiling surface while ventilating the indoor air through the opening.

A well-known ceiling mounted ventilation fan has a structure, for example, known as described in U.S. Pat. No. 7,175,309, incorporated herein by reference. This structure will be briefly described below with reference to FIG. 1. This structure includes a lamp 170, a lamp housing 106, an electrical socket 120, and a fan 104. A blower of the fan 104 is placed next to the lamp 170. And the lamp 170 is fixed on the main housing through the electrical socket 120. Since an air flow needs to pass through a long air passage before entering the blower in ventilating, and the lamp 170 is placed in the air passage, the pressure loss increases, the noise increases, and the ventilation performance is unstable.

SUMMARY

In view of the above technical problems, an aspect of the present disclosure is an airway device capable of improving lighting efficiency and ventilation efficiency.

The technical solutions adopted by an aspect of the present disclosure are as follows.

According to an aspect of the present disclosure, there is provided an airway device, comprising:

a main housing provided with a suction port and a blow port;

an air passage having a cylindrical shape, and having an inner circumferential surface defining an air flow path from the suction port to the blow port; and a lighting unit for illuminating the inner circumferential surface.

In some embodiments of the present disclosure, the air passage is provided with: an upstream-side opening, a downstream-side opening, and a connection wall connecting the upstream-side opening to the downstream-side opening.

In some embodiments of the present disclosure, the upstream-side opening is larger than the downstream-side opening.

In some embodiments of the present disclosure, the downstream-side opening is located inside the main housing or coincides with the suction port.

In some embodiments of the present disclosure, the upstream-side opening is located outside the main housing or coincides with the suction port.

In some embodiments of the present disclosure, the upstream-side opening is located outside the main housing and the downstream-side opening is located inside the main housing, allowing the air passage to go through the suction port.

In some embodiments of the present disclosure, the upstream-side opening of the air passage is located outside the main housing, and a flange member is extended from the upstream-side opening towards an outer circumference side.

In some embodiments of the present disclosure, the lighting unit comprises a light emitting element disposed on the inner circumferential surface of the air passage.

In some embodiments of the present disclosure, the air passage is formed of a light transmissive material, and the lighting unit comprises a light emitting element disposed on an outer peripheral side of the air passage.

In some embodiments of the present disclosure, the lighting unit comprises a cover disposed at an outer peripheral position of the light emitting element; the light emitting element is interposed between the cover and the air passage, and the cover is configured to reflect a light emitted from the light emitting element.

In some embodiments of the present disclosure, the lighting unit lights the flange member.

In some embodiments of the present disclosure, the lighting unit lights the flange member by provision of a light emitting element on the flange member.

In some embodiments of the present disclosure, the airway device is provided with a blower for directing an air from the suction port to the blow port, and the blower comprises: a fan; and a fan housing, having an air inlet opened toward the suction port and an air outlet opened toward the blow port, and surrounding the fan.

In some embodiments of the present disclosure, a central axis of the upstream-side opening is set on a same straight line with a rotary axis of the fan.

In some embodiments of the present disclosure, a diameter of the downstream-side opening of the air passage is the same as a diameter of the air inlet of the fan housing or smaller than the diameter of the air inlet of the fan housing.

In some embodiments of the present disclosure, the downstream-side opening of the air passage coincides with a plane to which the suction port belongs or is located on a downstream side of the plane.

In some embodiments of the present disclosure, a grid structure is disposed between the upstream-side opening and the air inlet of the fan housing.

As can be seen from the above technical solution(s), the airway device according to the present disclosure has at least one of the following beneficial effects.

(1) The present disclosure can reduce the pressure loss, increase the air volume, and suppress the noise while ensuring the lighting effect.

(2) The present disclosure can be externally connected to the ventilation device to allow air circulation with the outside, and the airway device can also provide illumination function.

(3) In the present disclosure the blower is disposed in the main housing, further improving the space utilization, and because the air directly passes from the outside through the connection wall and directly into the fan housing, the wind resistance is reduced and the ventilation efficiency is improved.

REFERENCE NUMERALS

Prior Art

Figure 1:
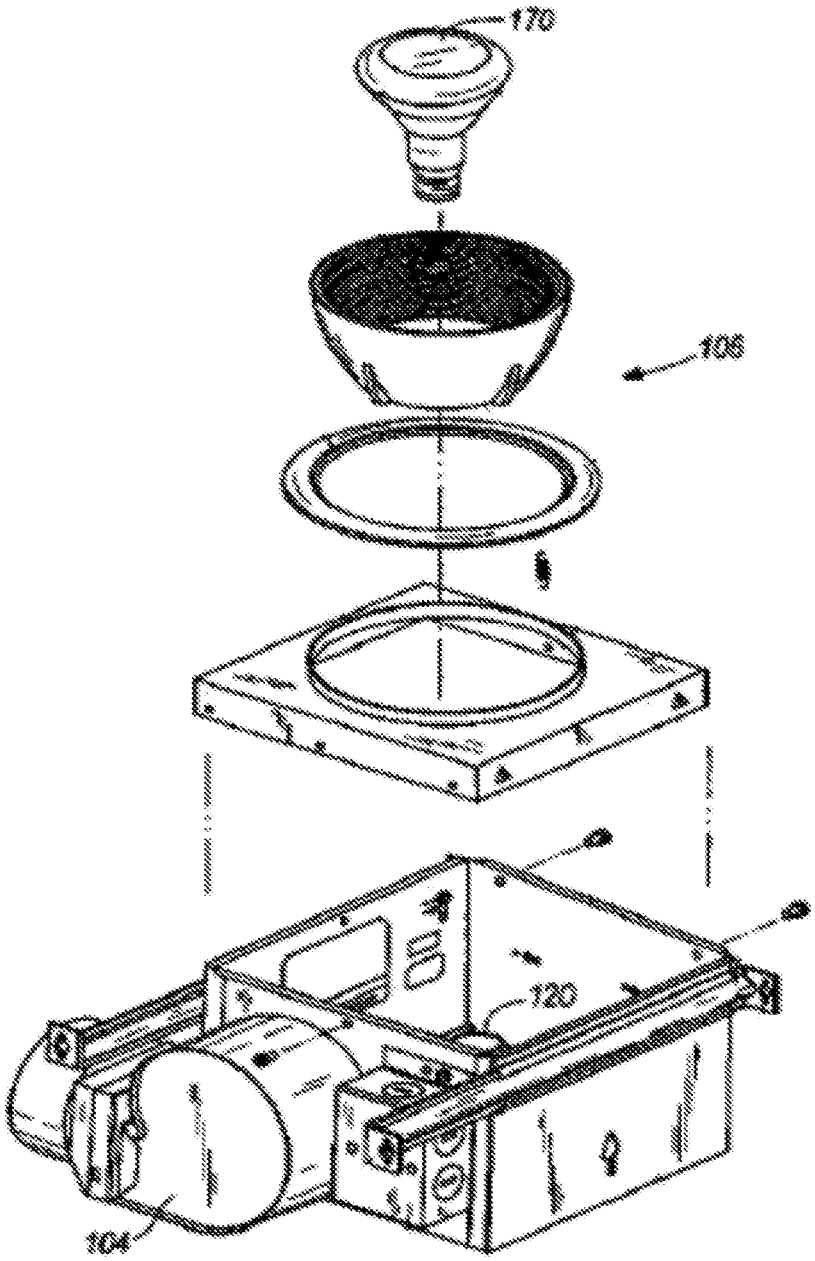
FIG. 1 is a schematic view showing a structure of a ceiling mounted ventilation fan in prior art.
Figure 2:
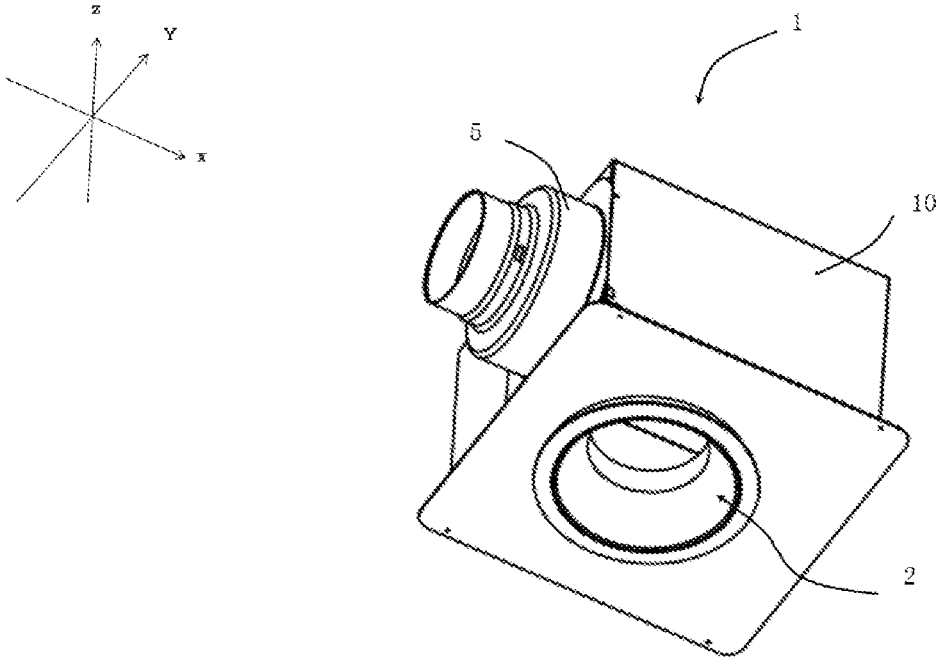
FIG. 2 is a perspective view of an airway device according to a first embodiment of the present disclosure.
Figure 3:
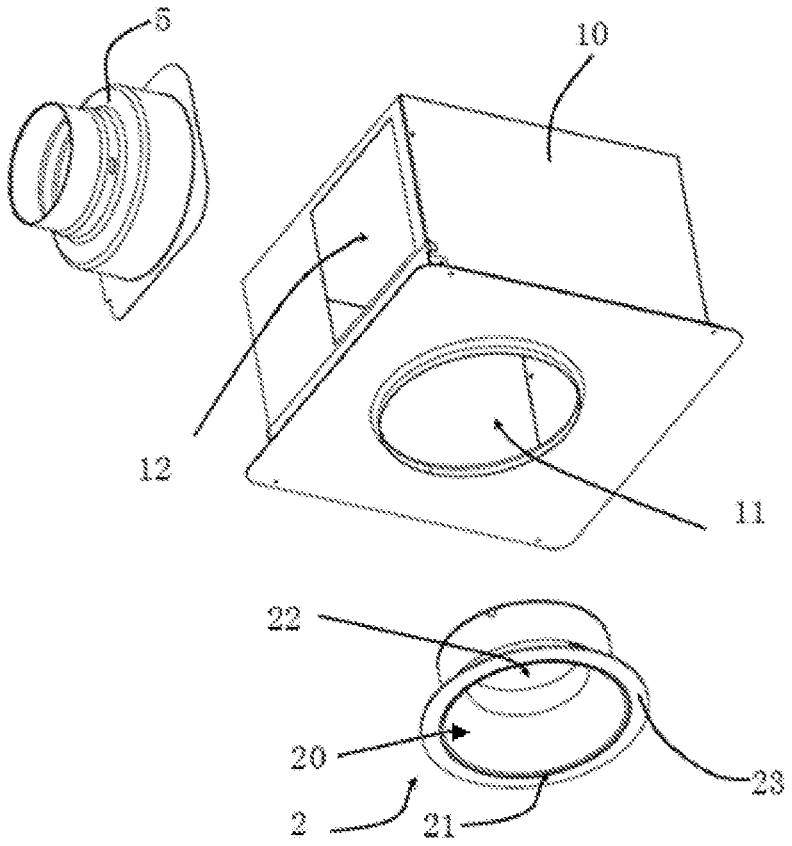
FIG. 3 is an exploded view of the airway device shown in FIG. 2.
Figure 4:
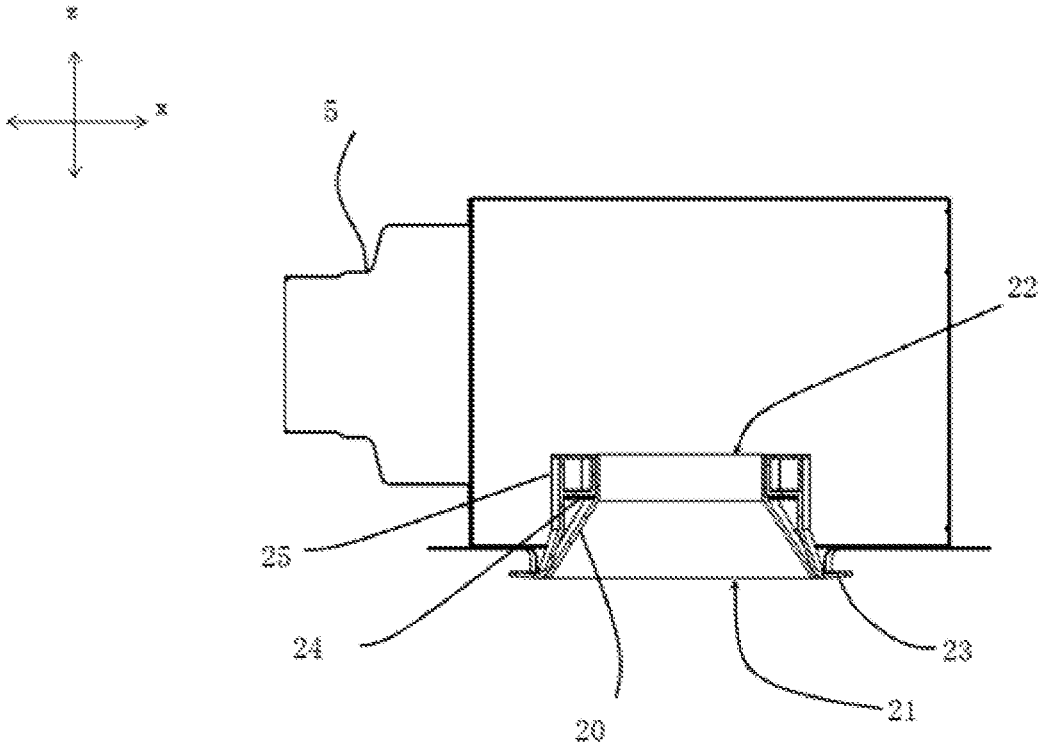
FIG. 4 is a cross sectional view (partial cross sectional view) when viewed from the Y direction of FIG. 2.

170—lamp
106—lamp housing
120—electrical socket
104—fan

The Present Disclosure

1—airway device
2—lighting unit
3—blower
4—ventilation device
5—passageway connection
6—passageway
7—ceiling
8—ceiling opening
10—main housing
11—suction port
12—blow port
20—connection wall
21—upstream-side opening
22—downstream-side opening
23—flange member
24—light emitting element
25—cover
26—grid structure
30—fan
31—fan housing
32—air inlet
33—air outlet
34—motor

DETAILED DESCRIPTION

In order to make the aspects, technical solutions and advantages of the present disclosure more apparent, the present disclosure will be further described in detail below in conjunction with specific embodiments and with reference to the accompanying drawings.

First Embodiment

In the present embodiment, there is provided an airway device. As shown in FIGS. 2 to 5, the airway device 1 comprises a main housing 10, an air passage, and a lighting unit 2.

The main housing 10 for forming an outer profile of the airway device has a top surface, a bottom surface and four side surfaces. The main housing 10 has a suction port 11 and a blow port 12, which can be provided on two different surfaces.

The lighting unit 2 has an upstream-side opening 21, a downstream-side opening 22, and a cylindrical-shaped connection wall 20 connecting the upstream-side opening 21 to the downstream-side opening 22. The inner circumferential surface of the cylindrical shaped connection wall 20 constitutes an air flow path, namely an air passage, from the suction port 11 to the blow port 12. Here, the cylindrical-shaped connection wall 20 may be a round cylindrical-shaped connection wall, or may be a square cylindrical-shaped connection wall, etc., and correspondingly, the inner circumferential surface of the cylindrical shaped connection wall 20 may be a round inner circumferential surface, or may be a square-shaped inner circumferential surface, etc.

The upstream-side opening 21 has a larger opening area than the downstream-side opening 22.

The downstream-side opening 22 is located inside the main housing 10 or coincides with the suction port 11. Here, "coincide with" means that the downstream-side opening 22 and the suction port 11 belong to the same plane. The "inside" means that the downstream-side opening 22 is located on the downstream side of the plane to which the suction port 11 belongs.

The upstream-side opening 21 is located outside the main housing 10 or coincides with the suction port 11. Here, "coincide with" means that the upstream-side opening 21 and the suction port 11 belong to the same plane. The "outside" means that the upstream-side opening 21 is located on the upstream side of the plane to which the suction port 11 belongs.

However, the upstream-side opening 21 and the downstream-side opening 22 do not coincide with the suction port 11 at the same time.

In addition, it may be provided that the upstream-side opening 21 is located outside the main housing 10 and the downstream-side opening 22 is located inside the main housing 10, so that the air passage formed by the lighting unit 2 passes through the suction port 11. Also, a flange member 23 is extended from the upstream-side opening 21 towards an outer circumference side.

The flange member 23 is plate-shaped as viewed from side. The flange member 23 is provided to cover the entire periphery of the upstream-side opening 21 and extends from the outer peripheral side of the upstream-side opening 21, that is, the flange member 23 is annular as viewed from below.

Figure 5:
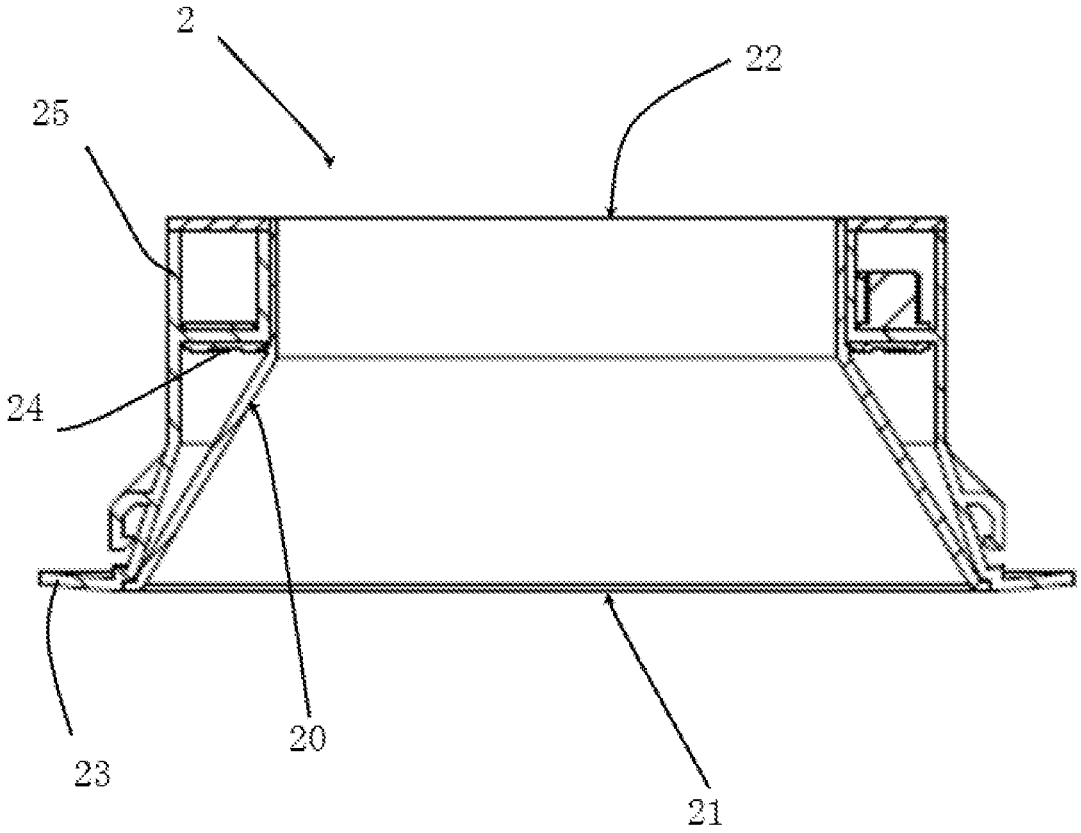
FIG. 5 is a cross sectional view (partial cross sectional view) of a lighting unit when viewed from the Y direction of FIG. 2.

As shown in FIG. 5, the air passage, that is, the connection wall 20, is formed of a light transmissive material. The lighting unit 2 includes a light emitting element 24 disposed on the outer peripheral side of the air passage and a cover 25 disposed at the outer peripheral position of the light emitting element 24. That is, in the present embodiment, the light emitting element 24 is inserted between the outer peripheral side of the connection wall 20, constituting the air passage, and the cover 25.

The light emitting element 24 is powered by a power supply structure provided in the main housing 10 to emit light.

The cover 25 constituting the lighting unit 2 has an inner circumferential surface which acts as the surface of the air passage and which reflects the light emitted from the light-emitting element 24.

The light emitted from the light-emitting element 24 is emitted to the connection wall 20 through the inner circumferential surface of the cover 25. That is to say, the cover 25 can suppress diffusion of the light from the outer peripheral side of the air passage.

The light emitted from the light-emitting element 24 and reflected by the cover 25, together with the light emitted directly from the light-emitting element 24, is transmitted through the air passage (the connection wall 20) formed of the light-transmitting material, so that the indoors can be efficiently illuminated.

In addition, by engaging the flange member 23 extended from the cover 25 of the lighting unit 2 on the ceiling, the position of the lighting unit 2 relative to the ceiling does not change even if the thickness of the ceiling changes, so the lighting effect does not vary with change of the thickness of the ceiling, and the same lighting effect can be obtained at various thicknesses of the ceiling.

In addition, when a fan 30 (described later) is operated, the indoor air passes through the upstream-side opening 21 and the downstream-side opening 22, enters the main housing 10, and is discharged from the blow port 12 to the outside. That is to say, the lighting unit 2 can provide the air passage required for ventilation and served as an air flow path. The light emitting element 24 is located outside the air passage, and the air flows in the air passage without being blocked by the light emitting element 24, accordingly, the pressure loss is reduced, the air volume is increased, and the noise is reduced.

Figure 9:
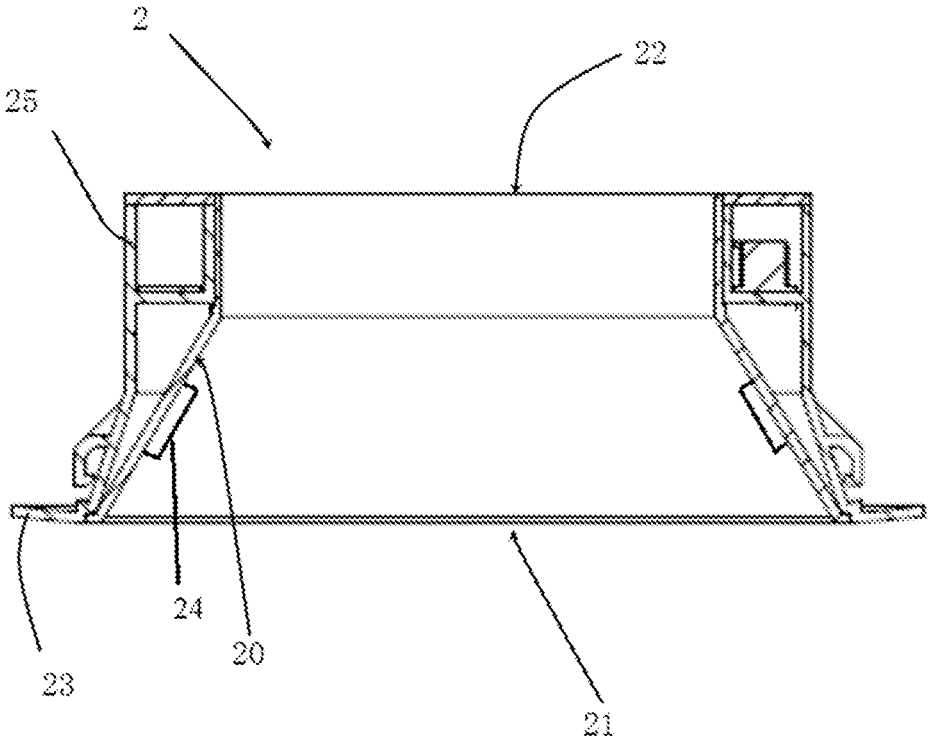
FIG. 9 is a cross sectional view (partial cross sectional view) of a lighting unit where the light emitting element is provided on the inner circumferential surface of the air passage.

In addition, a light emitting element 24 may be provided on the inner circumferential surface of the air passage (the connection wall 20) (see FIG. 9). As a result, the light emitted from the light emitting element can be directly radiated from the inner circumferential surface of the air passage to the indoors, thereby increasing the luminosity. What's more, cooling of the light-emitting element 24 by the airflow can be expected. With the above structure, the present disclosure can increase the air volume without affecting the lighting effect.

Second Embodiment

Figure 6:
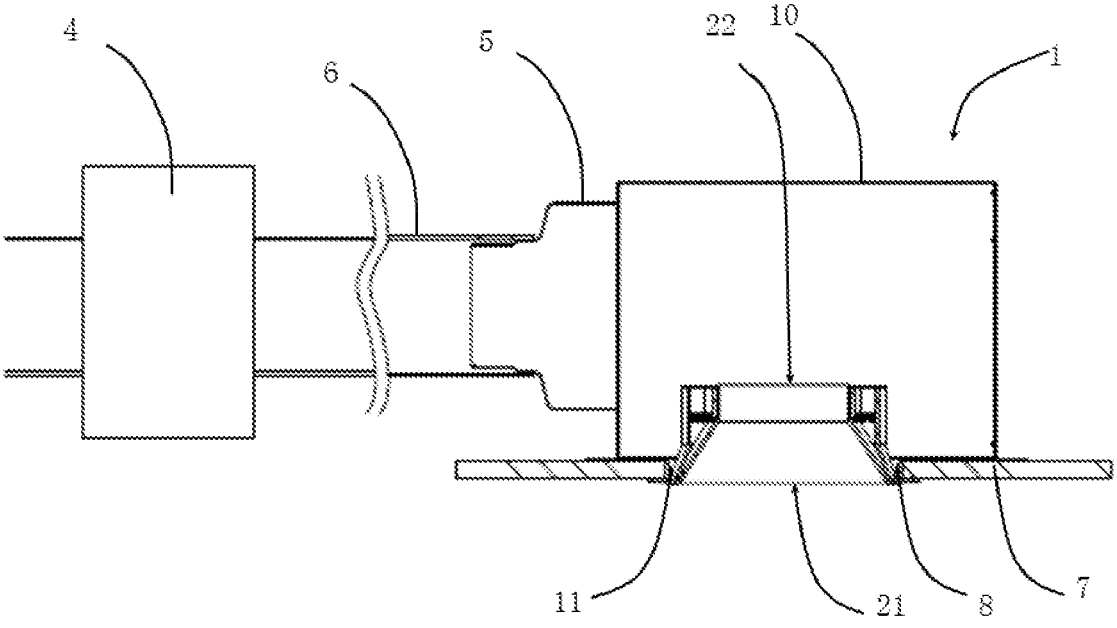
FIG. 6 is a cross sectional view (partial cross sectional view) of an airway device, as well as a ventilation device connected thereto, according to a second embodiment of the present disclosure.

In this embodiment, an airway device 1 is provided. As shown in FIG. 6, the airway device 1 of the present embodiment is different from the airway device 1 of the first embodiment as follows.

The suction port 11 is placed in the ceiling opening 8 formed by the ceiling 7, so that the suction port 11 and the flange member 23 are located indoors. The passageway 6 is connected to the main housing 10 through the passageway connection 5, and the passageway 6 is connected to the ventilation device 4 at the other end.

The ventilation device 4 is provided therein with, for example, a blower 3 as described below, so that the ventilation device 4 has a function of sucking air from one opening side into the ventilation device 4 and discharging it from the other opening side to the outside of the ventilation device 4. The ventilation device 4 drives the indoor air to flow from the upstream-side opening 21, the connection wall 20 and the downstream-side opening 22 into the main housing 10, and to be discharged from the blow port 12, and then the indoor air is passed through the passageway connection 5, the passageway 6 and the ventilation device 4, and is discharged to the outdoors.

With the above structure, the present disclosure can circulate the air with the outdoors via the airway device 1, and the airway device 1 can also provide illumination function.

Third Embodiment

Figure 7:
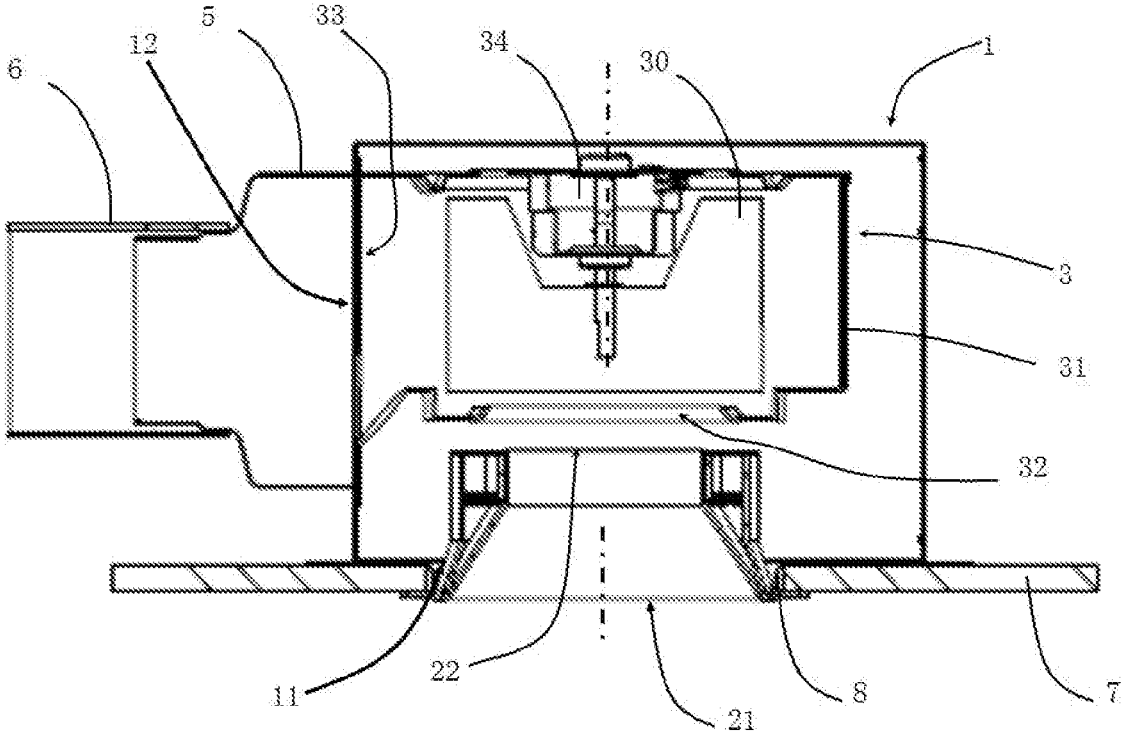
FIG. 7 is a cross sectional view (partial cross sectional view) of an airway device, as well as a blower, according to a third embodiment of the present disclosure.

In this embodiment, an airway device 1 is provided. As shown in FIG. 7, the airway device 1 of the present embodiment is different from the airway device 1 of the first embodiment as follows.

The airway device 1 is further provided with a blower 3 for directing an air from the suction port 11 to the blow port 12. In this case, without the ventilation device 4 shown in the second embodiment, the airway device 1 is implemented as a ventilation device.

As a form of the blower 3, a centrifugal blower such as a Sirocco fan is taken as an example, but other forms of blowers which are capable of realizing such an exhaust function may be employed. The blower 3 includes a fan 30, an air inlet 32 that is opened toward the suction port 11, an air outlet 33 that is opened toward the blow port 12, and a fan housing 31 that surrounds the fan 30. A central axis of the upstream-side opening 21 is set on a same straight line with a rotary axis of the fan 30. Here, the "same straight line" is not the same straight line in the absolute sense, but a certain deviation is allowed, and the present embodiment is not limited by this deviation. Here, the "certain deviation" refers to the deviation of the diameter of the rotary axis.

The diameter of the downstream-side opening 22 of the air passage is the same as a diameter of the air inlet 32 of the fan housing 31 or is smaller than the diameter of the air inlet 32. As a result, almost all of the air entering the main housing 10 from the downstream-side opening 22 enters the fan housing 31 and is discharged to the outdoors through the blow port 12. The air is prevented from flowing to the outer peripheral side of the air inlet 32 to collide with the fan housing 31 to cause turbulent flow.

The blower 3 drives the fan 30 by the motor 34, and the air enters the fan housing 31 from the indoors through the upstream-side opening 21, the downstream-side opening 22, and the air inlet 32, and then passes through the air outlet 33, the blow port 12, the passageway connection 5, and the passageway 6, so as to be discharged to the outdoors.

Since the central axis of the upstream-side opening 21 and the rotary axis of the fan 30 are arranged on the same straight line, the air can directly enter the fan housing 31 from the downstream-side opening 22, shortening the length of the air passage, reducing the wind resistance, and improving the ventilation efficiency. Moreover, the lighting function is integrated on the inner circumferential surface between the upstream-side opening and the downstream-side opening, and in particular, a required height of the main housing 10 is smaller and thus the size is reduced. Meanwhile, since installation of an illuminator in the air passage is not required, the resistance to the air passage can be reduced, thereby improving the air supply effect.

Fourth Embodiment

In this embodiment, an airway device 1 is provided. The airway device 1 of the present embodiment is different from the airway device 1 of the first embodiment as follows.

In the lighting unit 2, the light emitting element 24 interposed between the outer peripheral side of the connection wall 20 constituting the air passage and the cover 25 allows the flange member 23 to be illuminated. Alternatively, the flange member 23 can be illuminated by setting the light emitting element 24 on the flange member 23. Here, the expression "on the flange member 23" means that on the lower side surface of the flange member 23 or within the inside of the flange member 23 in the height (thickness) direction.

Fifth Embodiment

Figure 8:
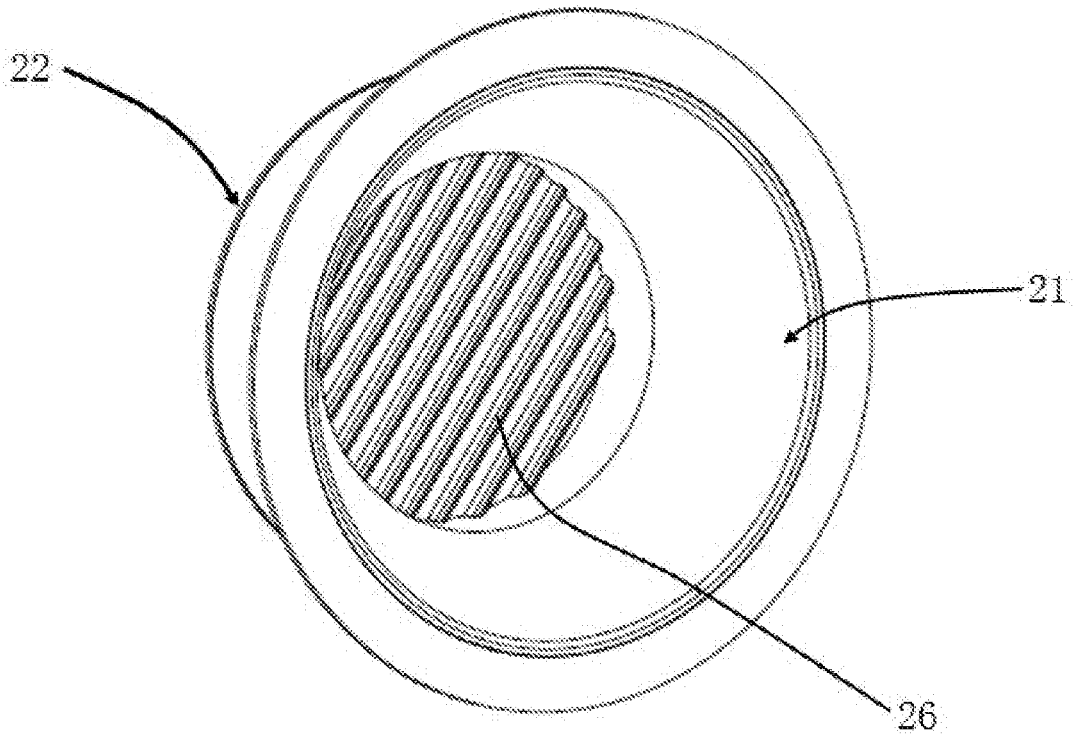
FIG. 8 is a top perspective view of a lighting unit according to a fifth embodiment of the present disclosure.

In this embodiment, an airway device 1 is provided. As shown in FIG. 8, the airway device 1 of the present embodiment is different from the airway device 1 of the first embodiment as follows.

A grid structure 26 is provided between the upstream-side opening 21 and the air inlet 32 of the fan housing 31. Specifically, the grid structure 26 can be provided between the upstream-side opening 21 and the downstream-side opening 22 of the lighting unit 2, or at the air inlet 32 of the fan housing 31. In particular, in the case where the blower 3 is provided, the user is prevented from seeing the blade rotation in the indoors, the appearance is improved, and the user is prevented from being injured by the insertion of hand into the operating fan.

The fourth and fifth embodiments of the present disclosure may be used separately or simultaneously, and connected to the ventilation device 4 or the blower 3 to constitute a ventilation apparatus.

In addition, in addition to the lighting unit 2 and other equipment that illuminate the indoors, it is also possible to provide device that emits sound to the indoors, such as a speaker, a notification device, etc.; or sensors for such as humidity, temperature, human body infrared induction, and gas induction; or device that heats the indoors, such as an electric heater, together with the blower 3, in the main housing 10.

Further, by appropriately combining any of the above-described embodiments, it is possible to achieve the effects of the respective embodiments.

Heretofore, the present disclosure has been described in detail in conjunction with the embodiments with reference to the accompanying drawings. Based on the above description, those skilled in the art should have a clear understanding of the airway device according to the present disclosure.

It is to be noted that the present disclosure is fully described in conjunction with the preferred embodiments with reference to the accompanying drawings. However, those skilled in the art will appreciate that various variations or modifications are possible. Such variations or modifications fall into the scope of the present disclosure as long as they do not depart from the scope of the present disclosure as defined by the claims.

It should be noted that the same elements are denoted by the same or similar reference numerals throughout the drawings. In the description, some specific embodiments are for illustrative purposes only and are not to be construed as limiting the present disclosure, but are merely exemplary embodiments of the present disclosure. Conventional structures or constructions will be omitted when it may cause confusion to the understanding of the present disclosure. It should be noted that the shapes and dimensions of the various components/elements in the figures do not reflect the true sizes and proportions, but merely illustrate the contents of the embodiments of the present disclosure.

The specific embodiments described above further explain the purpose, technical solutions and beneficial effects of the present disclosure, and it should be understood that the above description is only specific embodiments of the present disclosure, and is not intended to limit the present disclosure. Any modifications, equivalents, changes, etc., made within the spirit and principles of the present disclosure shall fall into the scope of the present disclosure.

What is claimed is:

1. An airway device, comprising:

a main housing provided with a suction port and a blow port;

an air passage having a cylindrical shape, and having an inner circumferential surface defining an air flow path from the suction port to the blow port; and a lighting unit for illuminating the inner circumferential surface, wherein the air passage is provided with: an upstream-side opening, a downstream-side opening, and a connection wall connecting the upstream-side opening to the downstream-side opening, the air passage is formed of a light transmissive material, and the lighting unit comprises a light emitting element disposed on an outer peripheral side of the air passage, the lighting unit comprises a cover disposed at an outer peripheral position of the light emitting element straddling between the upstream-side opening and the downstream-side opening, and the light emitting element is interposed between the cover and the connection wall, and the cover is configured to reflect, between the upstream-side opening and the downstream-side opening, a light emitted from the light emitting element straddling between the upstream-side opening and the downstream-side opening.

2. The airway device of claim 1, wherein the upstream-side opening is larger than the downstream-side opening.

3. The airway device of claim 1, wherein the downstream-side opening is located inside the main housing or coincides with the suction port.

4. The airway device of claim 1, wherein the upstream-side opening is located outside the main housing or coincides with the suction port.

5. The airway device of claim 1, wherein the upstream-side opening is located outside the main housing and the downstream-side opening is located inside the main housing, allowing the air passage to go through the suction port.

6. The airway device of claim 1, wherein the upstream-side opening of the air passage is located outside the main housing, and a flange member is extended from the upstream-side opening towards an outer circumference side.

7. The airway device of claim 6, wherein the lighting unit lights the flange member.

8. The airway device of claim 1, wherein the airway device is provided with a blower for directing an air from the suction port to the blow port, and the blower comprises:

a fan; and a fan housing, having an air inlet opened toward the suction port and an air outlet opened toward the blow port, and surrounding the fan.

9. The airway device of claim 8, wherein a central axis of the upstream-side opening is set on a same straight line with a rotary axis of the fan.

10. The airway device of claim 8, wherein a diameter of the downstream-side opening of the air passage is the same as a diameter of the air inlet of the fan housing or smaller than the diameter of the air inlet of the fan housing.

11. The airway device of claim 8, wherein the downstream-side opening of the air passage coincides with a plane to which the suction port belongs or is located on a downstream side of the plane.

12. The airway device of claim 8, wherein a grid structure is disposed between the upstream-side opening and the air inlet of the fan housing.

13. An airway device, comprising:

a main housing provided with a suction port and a blow port;

an air passage formed of a light transmissive material, having a cylindrical shape, and having an inner circumferential surface defining an air flow path from the suction port to the blow port; and a lighting unit for illuminating the inner circumferential surface of the air passage, the lighting unit comprising a light emitting element disposed on the inner circumferential surface of the air passage, wherein the air passage is provided with: an upstream-side opening, a downstream-side opening, and a connection wall connecting the upstream-side opening to the downstream-side opening, wherein the lighting unit comprises a cover disposed at an outer peripheral position of the light emitting element straddling between the upstream-side opening and the downstream-side opening, and wherein the cover is configured to reflect, between the upstream-side opening and the downstream-side opening, a light emitted from the light emitting element straddling between the upstream-side opening and the downstream-side opening.

14. An airway device, comprising:

a main housing provided with a suction port and a blow port;

an air passage having a cylindrical shape, formed of a light transmissive material, and having an inner circumferential surface defining an air flow path from the suction port to the blow port, the air passage being provided with: an upstream-side opening, a downstream-side opening, and a connection wall connecting the upstream-side opening to the downstream-side opening, the upstream-side opening of the air passage is located outside the main housing, and a flange member extends from the upstream-side opening towards an outer circumference side; and a lighting unit comprising a light emitting element disposed on the flange member and lights the flange member, wherein the lighting unit further comprises a cover disposed at an outer peripheral position of the light emitting element straddling between the upstream-side opening and the downstream-side opening, and wherein the cover is interposed between the light emitting element and the connection wall, and the cover is configured to reflect, between the upstream-side opening and the downstream-side opening, a light emitted from the light emitting element.

* * * * *